United States Patent [19]

Burnham et al.

[11] 4,249,142

[45] Feb. 3, 1981

[54] ENHANCEMENT OF LOWEST ORDER MODE OPERATION IN NONPLANAR DH INJECTION LASERS

[75] Inventors: Robert D. Burnham, Los Altos Hills; Donald R. Scifres, Los Altos, both of Calif.

[73] Assignee: Xerox Corporation, Stamford, Conn.

[21] Appl. No.: 964,863

[22] Filed: Nov. 30, 1978

[51] Int. Cl.[3] ..... H01S 3/19

[52] U.S. Cl. ..... 331/94.5 H; 357/18

[58] Field of Search ..... 331/94.5 H; 357/17, 357/18, 20, 88

[56] References Cited

U.S. PATENT DOCUMENTS

| | | | |
|---|---|---|---|
| 4,099,999 | 7/1978 | Burnham et al. | 148/187 |
| 4,166,253 | 8/1979 | Small et al. | 331/94.5 H |

OTHER PUBLICATIONS

D. Botez et al., "Constricted double-heterostructure (AlGa) As diode lasers", Appl. Phys. Lett., vol. 32, No. 4, Feb. 15, 1978, pp. 261–263.

*Primary Examiner*—James W. Davie

*Attorney, Agent, or Firm*—W. Douglas Carothers, Jr.

[57] ABSTRACT

By employing a channel in the substrate of a GaAs-GaAlAs injection laser, the active waveguiding layer of the laser can be made to have constricted regions above the shoulders of the substrate channel. The constricted regions are characterized as being of thin cross section as compared to immediate adjacent areas of the active layer and may be provided at one terminus point of the region with a pinch-off in the active layer. This configuration, upon proper stripe placement and current confinement through this region into the substrate channel will enhance light wave propagation in this region and improve fundamental transverse mode operation.

4 Claims, 4 Drawing Figures

ENHANCEMENT OF LOWEST ORDER MODE OPERATION IN NONPLANAR DH INJECTION LASERS

BACKGROUND OF INVENTION

This invention relates generally to heterostructure diode injection lasers and more particularly to stabilized filamentary lasing in a thin region of a nonplanar active layer of a double heterostructure (DH) injection laser.

It has been known to reduce the width of the filamentary area of the active layer of a double heterostructure injection laser. One manner of controlling active layer thicknesses is by providing a groove or channel structure in the laser substrate prior to LPE, MBE or OM-CVD growth processes for producing the junction layers, such as, disclosed in U.S. Pat. No. 3,978,428. Another manner of controlling active layer thickness is by providing a mesa structure on the laser substrate prior to LPE, MBE or OM-CVD growth processes as exemplified in U.S. Pat. 4,185,256.

We have discovered that in the case of channel substrate structured lasers, that some of those devices that were fabricated exhibited lasing preference in an area above the upper edge of the etched channel in the active layer. Lasing in this tapered or thin region or sector of the active layer provided control of the lowest order transverse mode. Stabilized lowest order mode operation is believed to be achieved because of the constricted nature of the active layer in this region of the laser and the employment of asymmetric pumping, i.e., positioning of the stripe geometry substantially over this constricted filamentary region of the active layer. Other higher order modes are not developed because they would extend into areas of decreased gain with attendent higher radiation and absorbsion losses.

OBJECTS OF THE INVENTION

It is the primary object of this invention to enhance fundamental transverse mode operation in injection lasers.

Another object of this invention is to enhance fundamental transverse mode operations in nonplanar DH diode laser structures to improve its utility in optical elements and integrated optical components.

SUMMARY OF INVENTION

In accordance with the present invention, a nonplanar DH diode injection laser is provided with current confinement means over the constricted region sector of the active layer of the laser. This region, due to layer growth processes explained in U.S. Pat. No. 3,978,428, is in the region of the upper edge or extremity of the channel in the substrate of the laser. The asymmetric positioning of the stripe relative to the substrate channel with proper current pumping establishes a higher effective index of refraction in the active layer constricted region.

Due to structural and current density parameters of the constricted region, stablized fundamental transverse mode operation is achieved. The structural parameter is characterized by an equivalent index of refraction in the constricted region which is lower than compared to adjacent portions of the active layer where layer thicknesses are greater. The current density parameter is characterized by an increase current density in the constricted region due to stripe contact placement and established current flow in the constricted region. This higher current density contributes to higher gain in this region and a higher effective index of refraction.

Also the established optical wave to some extent itself contributes to the higher effective index of refraction within the constricted region. As a result, stabilized lowest order mode operation is achieved, the restricted region having an effective refractive index profile characterized by a small central index rise with adjacent higher index rises due to decreased active layer thickness on at least one side adjacent the constricted region. A terminus point of the constricted region may also be characterized by a pinch-off point in the active layer.

Other objects and attainments together with a fuller understanding of the invention will become apparent and appreciated by referring to the following description and claims taken in conjunction with the accompanying drawings.

DESCRIPTION OF THE PREFERRED EMBODIMENT

Figure 1:
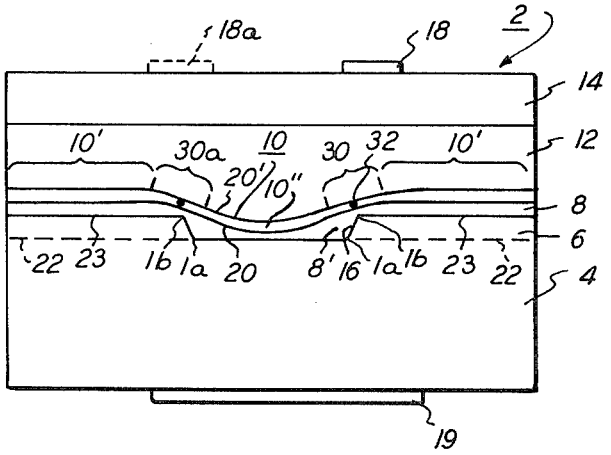
FIG. 1 is an illustration of a nonplanar DH injection laser adopted for fundamental transverse mode operation according to the present invention.

Referring now to FIG. 1, there is shown a nonplanar DH diode laser 2 in accordance with the present invention. By "nonplanar", the active layer 10 of the laser 2 is not planar. Laser 2 includes a substrate 4, a diffused layer 6 in substrate 4, a first light waveguiding and carrier confining layer 8, a nonplanar active layer 10 having central portion 10'' and end portions 10', a second light waveguiding and carrier confining layer 12, and a contact facilitating layer 14. The central portion of the layer 8 and the central portion 10' of the active layer are within a channel 16 formed in the substrate 4. Channel 16 is defined by lower extremities 1*a* and upper extremities 1*b*. Upper extremities 1*b* define a shoulder for channel 16.

Layer 8 and nonplanar active layer 10 are of different conductivity type to provide a rectifying junction 20 therebetween. Contacts 18 and 19 are, respectively, provided on layer 14 and substrate 4, to provide means for forward biasing rectifying junction 20 at the interface of layer 8 and active layer 10. Contact 18 is diagramatically shown and is intended to embrace any conventional stripe contact geometry as a means to produce selective current flow on the surface of laser 2. For example, stripe contact 18 could be made by several techniques, such as, proton implantation, selective etching, selective diffusion, nitride or oxide. Layers 4 and 8 are of different conductivity type than layer 6 such that second and third rectifying junctions 22 and 23 exist at the interface between layers 4 and 6, 6 and 8, respectively. When junction 20 is forward biased, junction 22 is also forward biased and junction 23 is back biased.

More specifically, substrate 4 can be n-type GaAs, layer 6 can be p-type GaAs, light waveguiding and carrier confining layer 8 can be n-type GaAlAs, active layer 10 can be p-type GaAs, light waveguiding and carrier confining layer 12 can be p-type GaAlAs, and contact facilitating layer 14 can be p-type GaAs.

Alternatively, nonplanar active layer 10 may be n-type GaAs in which case a rectifying junction 20' would exist between layer 10 and layer 12.

The shape of the central portion 10" of the active layer is controlled, in part, by the shape of the first light waveguiding and carrier confining layer 8 which has a central trough or elongated depression 8'. This is established during growth processes due to the presence of the channel 16 in substrate 4. There is a tendancy for nucleating atoms during such processes to attach themselves more readily at places requiring less energy for bonding to the substrate 4 and adjacent nucleating atoms. These places are inside corner areas such as at 1*a*. Form FIG. 1, it can be seen that the channel angles at lower extremities 1*a* are about 125° whereas the channel angles at upper extremities 1*b* are about 235°. Thus, there is a higher density of neighboring atoms at lower extremities 1*a* than at upper extremities 1*b* and hence nucleation and incorporation of growth semiconductor material into the substrate lattice can occur more easily at the lower extremities than at the upper extremities. Growth at convex extremities 1*b* is slower than growth above extremities 1*a*. Other nucleation control factors are discussed in U.S. Pat. No. 3,978,428.

The central portion 10" of the active layer is nonplanar relative to portions 10'. Also portion 10" is thicker in the central region than constricted regions 30 adjacent the upper extremities 1*b*. Beyond the extremities 1*b*, the active layer in portions 10' is thicker in cross-section than regions or sectors 30. Portions 10', in fact, may increase monotonically in thickness toward the ends of the portions. Thus, regions 30 provide a substantially uniform thin portion in the active layer that is bounded by portions of the active layer that are generally thicker in cross section.

Laser 2 does not have the large bowl shaped cross-section as does the laser shown in U.S. Pat. No. 3,978,428. The thickness of this region of the laser can be controlled during growth processes. In particular, the channel 16 is not etched as deep as the structure shown in the patent and the period of growth for confining layer 8 may be made longer to cause this first layer to become comparatively thicker.

The configuration of the central portion 10" is controlled by nucleation sites on layer 8 which, in turn, is controlled by the configuration of channel 16 and the degree of angularity of the sidewalls between extremities 1*a* and 1*b*.

A more bowl shaped configuration of portion 10 as exhibited by the laser structure of U.S. Pat. No. 3,978,428 patent would not detract from operating the laser in constricted region 30 of the nonplanar active layer 10 as disclosed herein. The prerequisite is that the active layer regions 10" and 10' adjacent to the constricted region 30 at least have a slightly greater cross-sectional thickness as compared to the thinner uniform thickness of these regions.

Laser 2 may be fabricated by the process disclosed in U.S. Pat. No. 3,978,428. Also MBE and OM-CVD deposition techniques may be employed.

The stripe contact 18 is positioned over the constricted region 30 above the shoulder extremity 1*b*. Pumping current is restricted generally to a path about shoulder extremity 1*b* and thence through channel 16. Due to the fact that areas adjacent to region 30 are of at least slightly larger cross-sectional thickness and that current flow is confined to this particular region due to stripe placement, lasing in region 30 is stablized. Light output occurs at 32 within the constricted region 30.

A stripe contact 18*a* may be positioned above the other constricted region 30*a* of active layer 10 and provide pumping for this region as previously explained in connection with region 30.

Fundamental transverse mode operation is achieved because of the refractive index profile obtained in region 30 of nonplanar active layer 10. The index profile is defined by two principal parameters. These are the structural guiding characteristics of region 30 (structural parameter) and the current flow directed to this region which establishes a high carrier density and corresponding light intensity at this region (current density and optical parameter). The light intensity itself contributes to an increase in the index profile but not to the extent of contribution obtained by the current density established at this point.

The structural guide is provided by region 30 which is slightly thinner in cross-section than adjacent side planar portions 10' and adjacent curved portion 10". This contributes to improved mode stability of either side of region 30.

Stripe placement also provides for higher carrier density in region 30 which increases the effective refractive index providing for higher gain. Also to a smaller extent, the increase in light intensity established at this point contributes to higher gain.

Also there are further, less significant, reasons that are believed to contribute to transverse mode stability. Due to different regions of possible growth rates caused by extremities 1*a* and 1*b* of channel 16, different doping concentrations can occur in a particular layer and lateral changes in aluminum concentration in a particular layer can occur. The faster the growth rate in a particular area, such as above channel 16 and extremities 1*a*, a slightly higher doping concentration is produced. Therefore, in thicker regions of material growth, higher doping levels will be produced. Also in aluminum containing layers, aluminum concentration will vary in a particular layer due to different growth rates. For example, lower concentrations in parts of layer 12 above region 30 may occur as compared to regions in the same layer above portion 10". The difference may be as small as 1% or less but result in a slight change in the index of refraction. Thus, the index may be slightly higher in region 30. These lateral changes may provide light refractive index changes which aid lasing stability in region 30.

Figure 3:
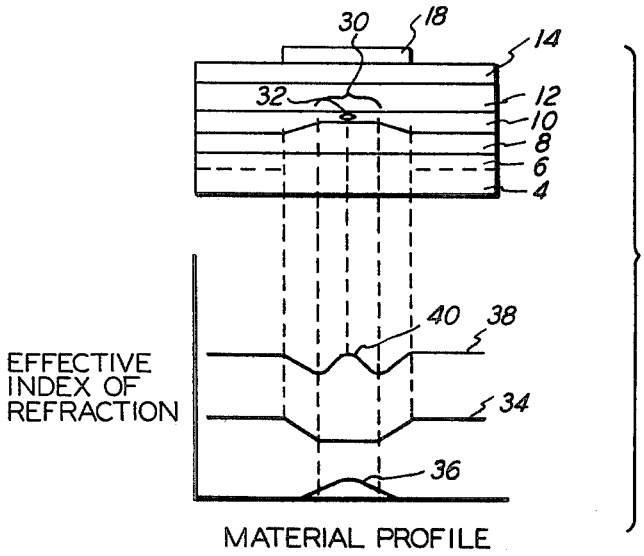
FIG. 3 is a diagrammatic illustration for explaining the nature of effective refractive index in the constricted region of the active layer of the laser of FIG. 1 due to higher carrier density.

Reference is made to FIG. 3 to illustrate diagrammatically the nature of the resultant refractive index due to changes in structural parameters and the effect of carrier density and optical parameters. Equivalent portions of the diagram of FIG. 3 to laser 2 of FIG. 1 are shown with the same numerical indication. Line 34 represents the equivalent index profile for change in structural parameters of layer 10 while line 36 represents the equivalent index profile for carrier and optical parameters. The resultant effective index profile for lines 34 and 36 is represented by line 38. In constricted region 30, the active layer 10 is thinner than adjacent regions of the same layer so that there is affectively a decrease in refractive index in this region. However, the carrier density in region 30 is higher due to stripe placement so that there is effectively an increase in the index as illustrated by line 36. This creates a hump 40 in the overall index 38. Lasing is stablized in the fundamental mode since there are higher radiation and absorbsion losses into areas adjacent to region 30 in active layer 10 while the lasing filament is maintained stable at the hump 40 due to the slightly higher index established at this point due mainly to carrier density and optical parameter, as previously explained.

Figure 2:
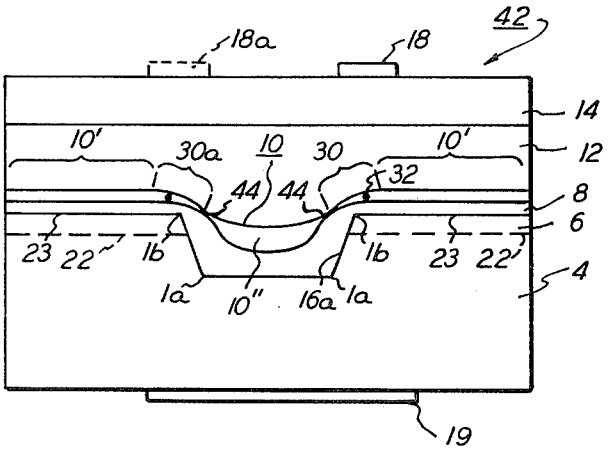
FIG. 2 is an illustration of a nonplanar DH injection laser similar to that shown in FIG. 1 but provided with pinch-off points in the active layer of the laser.

In FIG. 2, the DH laser 42 is substantially the same as the laser 2 of FIG. 1 and, therefore, like components and features are provided with the same numeral identification. Laser 42 differs in that channel 16*a* is deeper than channel 16 of laser 2. As a result, the thickness changes and regional growth rates for layer fabrication are different and are higher than those for the structure of FIG. 1. A pinch-off 44 occurs at one side of constricted region 30 in active layer 10. Also portions 10″ and 10′ of the active layer may be comparatively thicker than those same portions in laser 2.

As previously indicated, growth of layers 8 and 10 is at slower rate during fabrication above extremities 1*b* forming convex surface and less ability for molecular nucleation. If channel 16*a* is sufficiently deep, pinch-off 44 can occur in layer 10. Pinch-offs 44 help to confine current flow to a defined region through the active layer in region 30 and to stablize fundamental mode operation.

Figure 4:
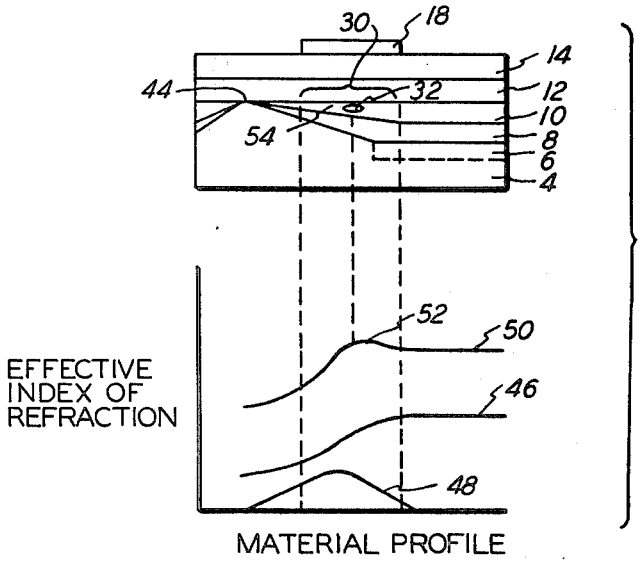
FIG. 4 is a diagrammatic illustration for explaining the nature of effective refractive index in the constricted region of the active layer of the laser of FIG. 2 due to carrier injection.

In FIG. 4, there is a diagrammatic illustration of the nature of the resultant refractive index due to changes in structural parameters (particularly due to pinch-offs 44) and the effect of current density and optical parameters. Equivalent portions of the diagram of FIG. 3 to the laser 42 of FIG. 2 are shown with the same numerical identification. Line 46 represents the equivalent index profile for change in structural parameters of layer 10 while line 48 represents the equivalent index profile for carrier and optical parameters. The resultant effective index profile for lines 46 and 48 is represented by line 50. Although current flow in the device may be more in the area 54 of region 30, carrier recombination occurs at 32. The carrier flow to and recombination will occur here particularly in view of the higher index established upon lasing as represented by the resultant index hump 52. Higher order modes are not established because of the pinch-off 44 on one side of region 30 and the higher radiation and absorbsion losses provided by adjacent portion 10′ of the active layer. The lasing filament is maintained stable at the position of the index hump 52.

While the invention has been described in conjunction with specific embodiments, it is evident that many alternatives, modifications and variations will be apparent to those skilled in the art in light of the foregoing description. Accordingly, it is intended to embrace all such alternatives, modifications, and variations as fall within the spirit and scope of the appended claims.

We claim:

1. In an injection laser comprising a substrate body having a surface with an elongated channel in said surface and having shoulders at the upper extremities thereof adjacent said surface, first, second and third layers of semiconductor material sequentially formed on said substrate and in said channel, said second layer having a material with a higher index of refraction and lower bandgap than the material of said first and third layers and forming the active layer for said laser, and constricted region formed in said active layer above at least one of said shoulders, current confinement means located above said constricted region and offset relative to said elongated channel to confine the pumping current through said constricted region whereby light wave propagation under lasing conditions occurs in said constricted region, and means located below said constricted region adjacent said channel and in the surface of said substrate for restricting the flow of pumping current to a path through said channel, both of said means contributing to the inducement light wave propagation in said constricted region.

2. The injection laser of claim 1 wherein said constricted region is characterized as having the thinnest cross sectional contour of said second layer.

3. The injection laser of claim 1 wherein there is a constricted region formed in said second layer above both of said shoulders, current confinement means located above both of said constricted regions relative to the upper surface of the laser to confine the pumping current through said constricted regions, and means located below both of said constricted regions adjacent said channel and in the surface of said substrate for restricting the flow of pumping current to a path through said channel, both of said means contributing to the inducement of light wave propagation in said constricted region.

4. The injection laser of claim 1 wherein there is a pinch-off in said second layer defining one terminal point of said constricted region.

* * * * *